United States Patent [19]

O'Hara et al.

[11] Patent Number: 4,681,516

[45] Date of Patent: Jul. 21, 1987

[54] LEAKAGE PREVENTING LIQUID SUPPLY PUMP

[75] Inventors: John G. O'Hara, Shoreview; Frederick A. Powers, Maple Grove; Steven E. Peter, Richfield, all of Minn.

[73] Assignee: Graco Inc., Minneapolis, Minn.

[21] Appl. No.: 926,084

[22] Filed: Nov. 3, 1986

Related U.S. Application Data

[63] Continuation of Ser. No. 735,581, May 20, 1985, abandoned.

[51] Int. Cl.[4] ..... F04B 19/04

[52] U.S. Cl. ..... 417/259; 417/439

[58] Field of Search ..... 417/439, 254–264

[56] References Cited

U.S. PATENT DOCUMENTS

| | | | |
|---|---|---|---|
| 1,526,909 | 2/1925 | Hiller | 417/439 |
| 1,787,700 | 1/1931 | Persons | 417/439 |
| 2,019,969 | 11/1935 | Holmes | 417/439 X |
| 3,109,379 | 11/1963 | English | 417/439 |
| 3,887,305 | 6/1975 | Ito | 417/439 |

FOREIGN PATENT DOCUMENTS

| | | | |
|---|---|---|---|
| 337271 | 5/1921 | Fed. Rep. of Germany | 417/439 |

*Primary Examiner*—Carlton R. Croyle
*Assistant Examiner*—Ted Olds

[57] ABSTRACT

A liquid supply pump adapted for coupling to a reciprocable motor, particularly for pumping liquids having thermosetting properties. The pump incorporates a double-acting piston in a pumping cylinder, driven by an elongated drive shaft which projects from the top of the pump for reciprocable motion, the pump having a lower intake valve and an upper exhaust valve, and an intermediate drive shaft seal above the pumping cylinder and a liquid and air drive shaft seal proximate the point of projection of the drive shaft from the pump, wherein said two seals are spaced apart by a distance greater than the pump stroke length, and a liquid drainage path from the intermediate seal back to the pump intake region.

2 Claims, 2 Drawing Figures

LEAKAGE PREVENTING LIQUID SUPPLY PUMP

This is a continuation of co-pending application Ser. No. 735,581 filed on May 20, 1985 now abandoned.

BACKGROUND OF THE INVENTION

The present invention relates to liquid supply pumps, and more particularly to linearly reciprocable liquid supply pumps for pumping liquids having thermosetting characteristics, wherein accumulations of such liquids which dry out and become set can impair the operability of the pump.

Linearly reciprocable liquid pumps have long been used in industry for a wide range of liquid delivery applications. For example, the assignee of the present invention manufactures a complete line of reciprocable pumps for transferring liquids ranging from water based materials to heavy viscous mastics and lubricants. All of such pumps are adaptable for connection to a reciprocating driving source, such as an air motor or hydraulic motor.

Liquid supply pumps of the type described herein can be classified from one perspective as single-acting pumps or double-acting pumps. The term "single-acting pump" describes a pump wherein liquid is drawn into the pump during one direction of the driving reciprocation and is expelled from the pump during the other direction of the driving reciprocation. The term "double-acting pump" refers to a pump wherein liquid is drawn into the pump during one direction of driving source reciprocation, but liquid is expelled from the pump during both directions of driving source reciprocation. The present invention is adaptable for both types of pump, although it is described herein with reference to the double-acting class of pumps.

Certain types of liquids present particular problems for the liquid supply pumps of the type disclosed herein, especially liquids which have thermosetting characteristics which tend to cure or solidify upon prolonged exposure to air. The liquids which typify these characteristics are, among others, isocyanates which are utilized in mixed form with various types of resins, and which when applied to various substrates tend to cure out over a relatively short time period and to form an extremely hard and durable surface after curing. The pumping of this type of material, in either mixed or unmixed form, creates particular problems in the pumping equipment, for care must be taken to avoid prolonged exposure of the materials to air, for otherwise the materials may tend to cure within the pumping mechanism itself and eventually cause the pump to become inoperative.

Various types of seals and sealing arrangements have been tried in such pumps, to isolate the interior components of the pump which tend to accumulate liquid over time from the external air and environment of the pump. Since such pumps are operatively reciprocated by an elongated shaft connected at one of its ends to a pumping piston, and projecting externally of the pump at its other end, attempts have been made to design liquid and air seals about the pump drive shaft proximate the point of emergence from the pump. However, since no seal can be developed with complete liquid and air sealing characteristics over extended periods of use, it is inevitable that the pumped liquids will eventually create leakage through the seal and become exposed to air to trigger the curing process. When this occurs, the cured liquid further degrades the liquid seal, thereby causing further leakage and eventually rendering the pump inoperative.

SUMMARY OF THE INVENTION

The present invention comprises a liquid supply pump having a reciprocable drive shaft coupled at an anterior end to a pumping piston and projecting at its other end externally of the pump for coupling to a source of reciprocating drive power. An intermediate liquid seal is placed about the pump drive shaft, having associated therewith a collection chamber for collecting leakage quantities and a drainage path to return such leakage quantities back to the pump intake. Further, a pump drive shaft air seal is provided proximate the exit point of the drive shaft from the pump, and at a distance from the intermediate seal exceeding the stroke length of the pump, thereby providing an intermediate chamber between the air seal and the intermediate seal which drains into the leakage chamber and isolates said intermediate chamber and said leakage chamber from exposure to air.

It is the principal object of the present invention to provide a liquid supply pump having complete isolation between the interior pump components which come into contact with the liquid and the air on the exterior of the pump.

It is a further object of the present invention to provide an intermediate liquid seal in a liquid supply pump with a leakage collection chamber and drainage path for returning the leakage liquid to the pump intake.

It is another object of the present invention to provide a liquid supply pump having a reciprocable drive shaft with upper and lower seals spaced apart a distance greater than the stroke of the pump.

BRIEF DESCRIPTION OF THE DRAWINGS

The inventive features of the liquid supply pump will best be understood with reference to the following specification and claims, and to the appended drawings, in which:

DESCRIPTION OF THE PREFERRED EMBODIMENT

Figure 1:
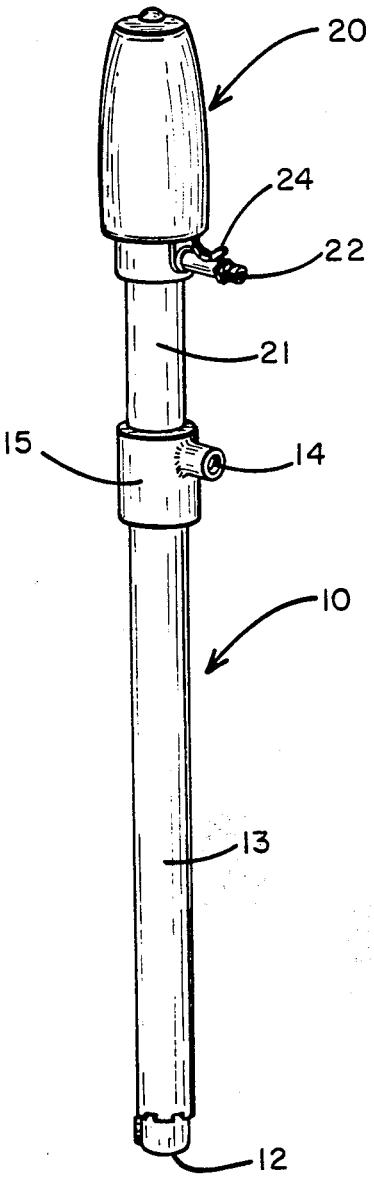
FIG. 1 shows a perspective view of one form of the invention.

Referring first to FIG. 1, there is shown in perspective view a pump and drive motor of the type generally suited to the present invention. Drive motor 20 is typically a reciprocable air-driven motor, driven by a source of compressed air which is attached at coupler 22, and which may be controlled by valve 24. Drive motor 20 is attached to one end of a motor-mounting tube 21, the other end of which is affixed to an outlet chamber casting 15. Outlet chamber casting 15 forms a part of pump 10, and has a pump outlet 14 associated therewith. Pump 10 has a housing 13 extending downwardly and terminating at a pump intake 12, in the valve intake body.

In operation, pump 10 is typically immersed into a supply of liquid, such as a 55 gallon drum, with pump intake 12 positioned near the bottom of the liquid supply container, and pump outlet 14 being positioned above the upper level of the liquid in the container.

Figure 2:
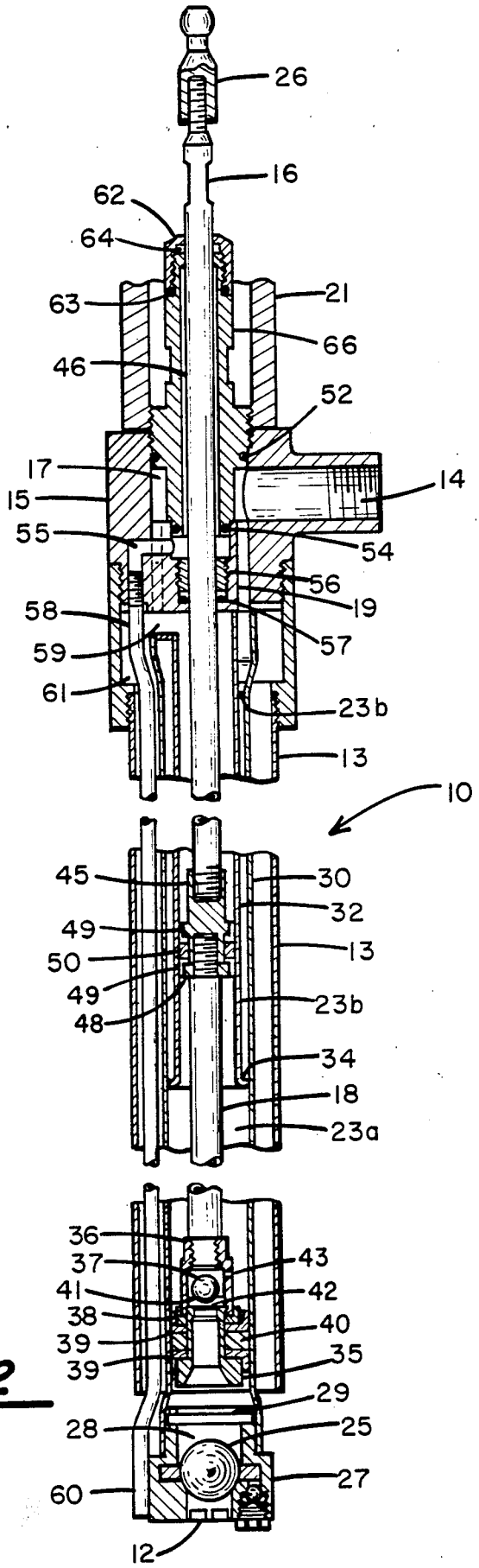
FIG. 2 shows an elevational cross sectional view of the pump shown in FIG. 1.

Referring next to FIG. 2, pump 10 is shown in somewhat enlarged and cross sectional view. Pump 10 is driven by an upper connecting rod 16, having a drive link 26 adapted for connection to drive motor 20. Upper connecting rod 16 passes through neck 66 and is threadably attached to upper piston body 45. Lower connecting rod 18 is threadably attached to the underside of upper piston body 45, and extends downwardly to a threadable connection to lower piston valve housing 36.

Lower piston valve housing 36 is threadably connected to lower piston body 35. A pair of cup seals 39, a lower piston bearing 40, and a lower piston seal backup 38 are clamped between lower piston body 35 and lower piston valve housing 36. A lower piston ball valve 37 is movably contained within a valve chamber 41, and may be seated against a valve seat 42. Lower piston valve housing 36 has a plurality of passages 43 therethrough, so as to provide a flow path from valve chamber 41 to pump chamber 23*a*.

Upper piston body 45 is threadably attached to upper connecting rod 16 and to lower connecting rod 18. A pair of upper piston cup seals 49, an upper piston bearing 50, and an upper piston seal backup 48 are all clamped between lower connecting rod 18 and upper piston body 45. Cup seals 49 and piston bearing 50 provide a liquid seal about the inside surface of inner cylinder 32. Similarly, cup seals 39 and piston bearing 40 provide a liquid seal about the inner surface of outer cylinder 30.

Pump intake 12 provides a flow path to intake valve ball 25, which is movably seated in an intake chamber 28. The upward movement of intake valve ball 25 is limited by a ball stop pin 29 which is secured across intake chamber 28.

Pump chamber 23*a* is in direct flow communication with pump chamber 23*b* via perforations through perforated spacer 34. Pump chamber 23*b* is connected via a plurality of outlet passages 19 to an outlet chamber 17. Outlet chamber 17 is in flow communication with pump outlet 14, and is sealed by upper O-ring 52 and lower O-ring 54.

Upper connecting rod 16 passes through a seal nut 62, which contains a seal 64 at the top end of neck 66. An O-ring 63 forms a seal between neck 66 and seal nut 62.

Upper connecting rod 16 also passes through a seal nut 56 which is threadably attached to a bore in outlet chamber casting 15, and a liquid seal 57 is secured by seal nut 56 to provide liquid sealing about upper connecting rod 16. A leakage connection chamber 55 is formed in the region immediately above seal nut 56, and is in flow connection with a drainage passage 58. Drainage passage 58 passes downwardly inside of pump housing 13 to a drain outlet 60 proximate pump intake 12.

An elongated chamber 46 is thus created between leakage collection chamber 55 and the upper end of neck 66. The top end of elongated chamber 46 is completely sealed from air leakage by O-ring 63 and seal 64. The lower end of elongated chamber 46 is in flow communication with leakage collection chamber 55. The overall length of elongated chamber 46 is selected to be longer than the maximum stroke length of pump 10, so that any liquid leakage which might accumulate on the lower portions of upper connecting rod 16 can never be carried upwardly to the top of neck 66. There is thereby created a distance barrier which insures that pumped liquid cannot reach the elevated position of seal 64 and therefore cannot affect the sealing function of seal 64.

A bypass channel 59 is formed between the inner cylinder 32 and the space between outer cylinder 30 and pump housing 13. This space is identified as intermediate chamber 61 on FIG. 2, and intermediate chamber 61 extends concentrically downward to the bottom of the pump, between pump housing 13 and outer cylinder 30. Bypass channel 59 provides a convenient overflow channel for liquid which collects inside of inner cylinder 32. During operation of the pump, the inside volume of inner cylinder 32 gradually fills with liquid, which leaks past upper piston seals 48 and 49. This liquid will accumulate until it reaches the level of bypass channel 59, whereupon it will seek a drain through intermediate chamber 61. Bypass channel 59 therefore provides a means for relieving internal pressure buildup against seal 57, and tends to minimize the leakage of liquid past seal 57. Pump housing 13 serves primarily to enclose this drainage path, thereby preventing any liquid which passes through intermediate chamber 61 from becoming exposed to air. This is particularly important in the case of pumps which transfer isocyanate materials and other materials which are affected by exposure to air.

In operation, the drive motor connected to drive link 26 causes vertical reciprocating motion of the connecting rods and the upper and lower pistons. During an upstroke the lower piston will create a suction force to draw liquid into pump intake 12, while at the same time will force liquid previously contained within pump chamber 23*a* and 23*b* to be injected through pump outlet 14. During the time when this upstroke motion takes place, intake valve ball 25 is lifted from its seat in intake chamber 28 and lower piston valve ball 37 is forced into sealing relationship against its seat 42. At the completion of an upstroke the two pistons are in upper positions in their respective cylinders, and the region beneath lower piston body 35 has been filled with liquid drawn into pump 10 through intake 12.

During the downstroke of the connecting rods and pistons the intake valve ball 25 is securely held against its seat through downstroke pressure created by the pistons. Conversely, lower piston valve ball 37 is lifted from its seat, and the liquid trapped beneath lower piston body 35 is forcibly ejected upwardly through valve chamber 41, passages 43, and into pump chamber 23*a* and pump chamber 23*b*. This upward flow of liquid again passes through outlet passage 19 to pump outlet 14.

The stroke of pump 10 is controlled by the selection of the reciprocable drive motor 20, or by appropriate stroke selection controls associated with drive motor 20, according to techniques which are well known in the prior art. For example, the assignee of the present invention manufactures a complete line of air and hydraulic motors having stroke controls and adjustments. It is important to the present invention that the length of neck 66, to thereby produce elongated chamber 46, be made longer than the maximum stroke of the reciprocable drive motor 20. This insures that pumped liquid can never be carried by connecting rod 16 to come into contact with seal 64, regardless of the leakage condition of the respective seals, and particularly seal 57.

Leakage through the seals of the pump of the present invention is further inhibited by bypass channel 59 and intermediate chamber 61, which provides a convenient drainage path for liquid which has accumulated in inner cylinder 32 above upper piston 45. This liquid will normally accumulate over time, as the seals associated with piston 45 will permit some bypass. When the liquid level in inner cylinder 32 reaches the top of inner cylinder 32 it will bypass through channel 59 and intermediate chamber 61 back to the bottom of the pump. This reduces the liquid accumulation which might otherwise prematurely wear and cause leakage of seal 57.

It will be appreciated that the extended operation of pump 10 will inevitably lead to leakage of the respective piston seals, and will also inevitably lead to leakage of seal 57. Such leakage invariably begins as a very small liquid seepage through the seals, and the seepage generally increases until seal replacement is accomplished through preventive maintenance. The present invention overcomes the problem of seal leakage, by the placement of leakage collection chamber 55 immediately above the seal 57, so as to collect the leakage accumulations and to drain such accumulations downwardly through passage 58 back to the liquid supply container. Therefore, even if a small amount of leakage accumulates in leakage collection chamber 55 it will be drained from pump 10 before it can develop a buildup in chamber 46. Further, any accumulations on connecting rod 16 caused by leakage in chamber 55 will not be carried to seal 64 because of the length of neck 66.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A reciprocable liquid supply pump for pumping thermosetting liquids and the like and adapted for driving connection through a predetermined stroke to a reciprocable motor through a connecting rod projecting from a housing casting at an upper end of said pump, comprising (a) a liquid outlet in said housing casting approximate the upper end of said pump and a downwardly projecting pump outer cylinder attached to said housing and having an upper interior portion in a liquid flow communication with said outlet;

(b) an inner cylinder attached to said housing casting and concentrically positioned inside the upper end of said pump cylinder, and having an upper interior portion isolated from liquid flow communication with said outlet, and having a lower interior portion in liquid flow communication with said outlet;

(c) an outer cylinder housing concentrically positioned about said pump outer cylinder and attached at an upper end to said housing casting, said outer cylinder housing extending downwardly and terminating in an opening about said pump outer cylinder;

(d) a first chamber and passage in said housing casting, said first chamber and passage providing liquid flow communication between the interior of said inner cylinder and the interior of said outer cylinder housing;

(e) a lower piston attached to said connecting rod and slidably positioned in said pump outer cylinder;

(f) an upper piston attached to said connecting rod and slidably positioned in said inner cylinder between the upper interior portion and the lower interior portion of said inner cylinder;

(g) a seal in said housing casting above said first chamber and about said connecting rod, and a second chamber above said seal; and (h) a bleed tube attached to said housing casting and having an upper opening in flow communication with said second chamber and a lower opening projecting downwardly to at least said outer cylinder housing lower opening.

2. The apparatus of claim 1, further comprising an inlet check valve attached at the lower end of said pump outer cylinder, and further comprising said bleed tube lower opening projecting downwardly to proximate said check valve.

* * * * *